US009364868B2

(12) United States Patent
Bullard et al.

(10) Patent No.: US 9,364,868 B2
(45) Date of Patent: Jun. 14, 2016

(54) ADJUSTABLE STOCK ASSEMBLY FOR FLUID SPRAY GUN AND METHODS

(71) Applicant: Federal Signal Corporation, Oak Brook, IL (US)

(72) Inventors: Michael J. Bullard, Tomball, TX (US); Curtiss G. Kennedy, Naperville, IL (US); Daniel P. Strauser, Elgin, IL (US)

(73) Assignee: Federal Signal Corporation, Oak Brook, IL (US)

( * ) Notice: Subject to any disclaimer, the term of this patent is extended or adjusted under 35 U.S.C. 154(b) by 337 days.

(21) Appl. No.: 14/018,898

(22) Filed: Sep. 5, 2013

(65) Prior Publication Data

US 2015/0060567 A1 Mar. 5, 2015

(51) Int. Cl.
*B08B 3/02* (2006.01)

(52) U.S. Cl.
CPC ..... *B08B 3/028* (2013.01); *Y10T 29/49815* (2015.01); *Y10T 29/49826* (2015.01)

(58) Field of Classification Search
CPC ..... F41A 23/10; F41A 11/02; F41A 35/06; F41A 5/28; Y10T 16/469; Y10T 16/473; G03B 17/561
USPC ..... 239/153; 42/71.01, 72
See application file for complete search history.

(56) References Cited

U.S. PATENT DOCUMENTS 3,799,440 A * 3/1974 Goss ..... B60S 3/044 138/114
3,885,739 A * 5/1975 Tuttle ..... B05B 9/01 222/331
3,986,523 A 10/1976 Pacht
3,987,963 A * 10/1976 Pacht ..... B05B 3/02 118/306
4,216,911 A 8/1980 Huperz et al.
4,349,154 A * 9/1982 Pacht ..... B05B 1/30 137/625.6
5,199,642 A * 4/1993 Rankin ..... B05B 1/1609 137/269
5,253,808 A * 10/1993 Pacht ..... B05B 1/1609 137/625.6
5,311,905 A 5/1994 De Santis
5,360,168 A 11/1994 McCue
5,535,949 A * 7/1996 Boisture ..... F16P 3/22 239/124
5,636,789 A * 6/1997 Shook ..... B05B 1/1609 239/124
5,904,297 A * 5/1999 Kendrick, Jr. ..... B05B 1/1681 239/124
6,651,910 B2 11/2003 Elliott-Moore
6,880,767 B2 4/2005 Herhold
7,083,124 B2 8/2006 Bednorz et al.
8,146,193 B1 4/2012 Franzino et al.
8,381,427 B2 2/2013 Nill
9,216,441 B2 * 12/2015 Pacht ..... B08B 3/028
2012/0223163 A1 9/2012 Pacht

OTHER PUBLICATIONS

Hammelmann Brochure, Germany (60 pages) received Aug. 6, 2013.

* cited by examiner

*Primary Examiner* — Troy Chambers
*Assistant Examiner* — Bridget Cochran
(74) *Attorney, Agent, or Firm* — Merchant & Gould P.C.

(57) ABSTRACT

An adjustable stock assembly for a fluid spray gun can be adjusted to have a different profile shape; and/or to have a different rotational position relative to the rest of the spray gun; and/or to have a different length relative to the rest of the spray gun; and/or to have a different tilt angle relative to the rest of the spray gun.

13 Claims, 11 Drawing Sheets

ADJUSTABLE STOCK ASSEMBLY FOR FLUID SPRAY GUN AND METHODS

TECHNICAL FIELD

This application concerns fluid spray guns, and in particular, a high pressure water jetting gun having an adjustable stock assembly.

BACKGROUND

Water jetting guns are known. One example water jetting gun is described in US Patent publication 2012/0223163, incorporated herein by reference. Such equipment can be used for cleaning, and other uses. Typically, fluid, such as water, is in a tank and is conveyed by a hose to the spray gun. The flow of the water is controlled through the gun by way of a trigger and valve mechanism. Typical pressures are in the range of 5,000-40,000 psi.

There is a need to improve the ergonomics and comfort for the person operating the spray gun.

SUMMARY

In one aspect, the disclosure concerns an adjustable stock assembly for fluid spray gun. The stock assembly includes a flexible body rest pad arrangement having a profile shape, and a pad shape adjustment system.

The pad shape adjustment system is operable to change the profile shape of the pad arrangement.

The profile shape of the pad arrangement is preferably made to be adjustable between at least a concave profile shape, a convex profile shape, and a straight profile shape.

Independent of the above, the pad arrangement is preferably adjustable relative to a remaining portion of the stock assembly and/or fluid spray gun. One adjustment includes rotational adjustment. In another example, and independent of the above, the pad arrangement is lengthwise adjustable relative to a remaining portion of the fluid spray gun. In another example, and independent of the above, the pad arrangement is tiltable relative to a remaining portion of the stock assembly and/or the spray gun.

In another aspect, a fluid spray gun is provided. The fluid spray gun includes a fluid supply tube, a block, in which the fluid supply tube is in communication with the block, a barrel in fluid communication with the block, a trigger operably controlling fluid release from the block into the barrel, and an adjustable stock assembly connected to the block. The stock assembly includes a pad arrangement that is adjustable.

The pad arrangement can be adjustable by having a changeable profile shape.

The pad arrangement can be adjustable by being rotationally positionable relative to a remaining portion of the spray gun.

The pad arrangement can be adjustable by being positionable lengthwise from a remaining portion of the spray gun.

The pad arrangement can be tiltable relative to an axis of the spray gun.

The pad arrangement can be adjustable by being all of, or individually, or any selective combination of each of the following: (i) having a changeable profile shape; (ii) and/or being rotationally positionable relative to a remaining portion of the spray gun; (iii) and/or being positionable lengthwise from a remaining portion of the spray gun; (iv) and/or being tiltable relative to a remaining portion of the spray gun.

In another aspect, a method of changing the profile shape of a pad arrangement of a stock assembly is provided. The method includes loosening a connection between a linkage arrangement and a remaining portion of the stock assembly, moving the linkage arrangement to cause the profile shape of the pad arrangement to change from an initial shape to a new shape; and tightening the connection between the linkage arrangement and the remaining portion of the stock assembly to fix the new shape of the pad arrangement.

A method of changing a tilt angle of a pad arrangement of a stock assembly of a spray gun, relative to an axis of the spray gun is provided. The method includes providing a spray gun having a stock assembly with a pad arrangement and a linkage arrangement secured thereto; and moving the linkage arrangement to cause the pad arrangement to angle relative to the axis of the spray gun from an initial position to a new position.

An adjustable stock assembly for a fluid spray gun is provided including a body rest pad arrangement, the pad arrangement having first and second opposite ends; a first extension member secured to the pad arrangement; and a linkage arrangement secured to the pad arrangement; the linkage arrangement being moveable to cause one of the first and second opposite ends of the pad arrangement to tilt away from an original position to a new position angled from the initial position.

The disclosure includes further assemblies, methods, and features that are further described below and in the detailed description and in the attached drawings.

DETAILED DESCRIPTION

Fluid spray guns, for example high pressure water blast guns, are known. In the past, operators of these types of spray guns were not allowed to adjust the stock to achieve a comfortable position during operation, specifically, during blasting. Principles described in this disclosure address these problems.

For example, in one aspect, one of the principles described herein allows for the operator to change the shape of the body rest pad.

Independent of the above, in another aspect, principles of this disclosure describe allowing the operator to adjust the angular (rotational) orientation of the body rest pad.

Independent of the above, and in another aspect, principles of this disclosure allow for changing the length of the stock to accommodate different sizes of the operator.

Independent of the above, and in another aspect, principles of this disclosure allow for changing the tilt angle of the body rest pad.

Figure 1:
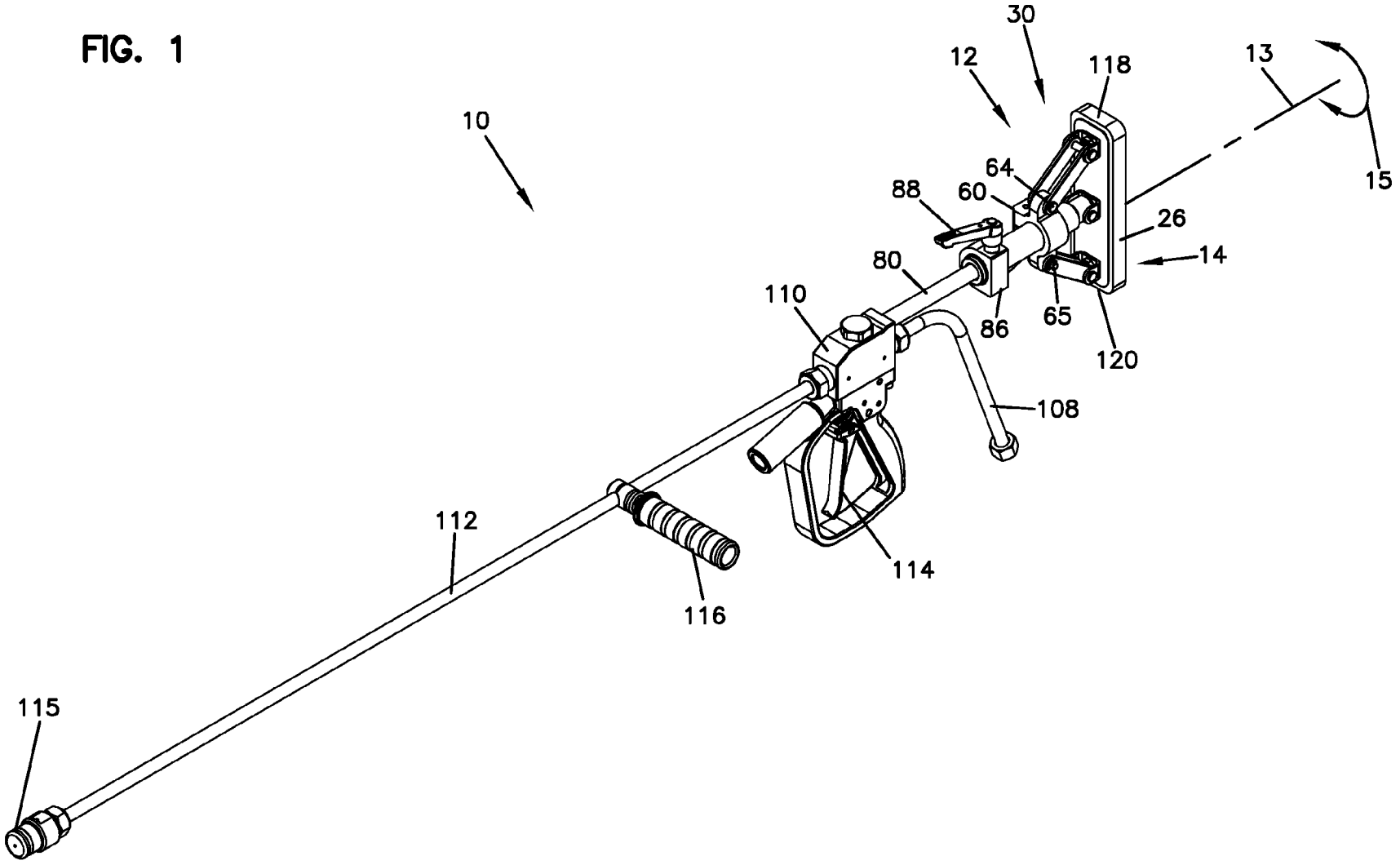
FIG. 1 is a perspective view of a first embodiment of a fluid spray gun including principles of this disclosure.

First, in reference to FIG. 1, a fluid spray gun is shown generally at 10. The fluid spray gun can be, for example, a high pressure water blast gun, for use in spraying high pressure water for use in cleaning and other applications. By high pressure, it is meant pressures along the lines of at least 10,000 psi up to 40,000 psi.

In FIG. 1, the fluid spray gun 10 includes a stock assembly 12. The stock assembly 12 is adjustable.

In a first example, the stock assembly 12 is adjustable in terms of shape. The shape can be adjusted between shapes including, for example: concave, and/or convex, and/or straight. The degree of concaveness and degree of convexity is adjustable.

Independent of the above, the stock assembly 12 is rotatably adjustable relative to the rest of the stock assembly 12 and/or gun 10 about a longitudinal axis 13 in FIG. 1. See the arrow 15 in FIG. 1 showing angular rotation about axis 13.

Independent of the above, the stock assembly 12 is lengthwise adjustable relative to the rest of the gun 10. See the arrow line 19 in FIG. 7.

Independent of the above, the stock assembly is tiltable relative to the rest of the stock assembly 12 and/or gun 10 relative to longitudinal axis 13. See the angles T in FIGS. 11-13.

The stock assembly 12 includes a body rest pad arrangement 14. The pad arrangement 14 has a profile shape. In FIG. 1, the profile shape of the pad arrangement 14 is generally straight, linear, and non-curved. The shape of the profile of the pad arrangement 14 can be changed, as described further below.

Figure 5:
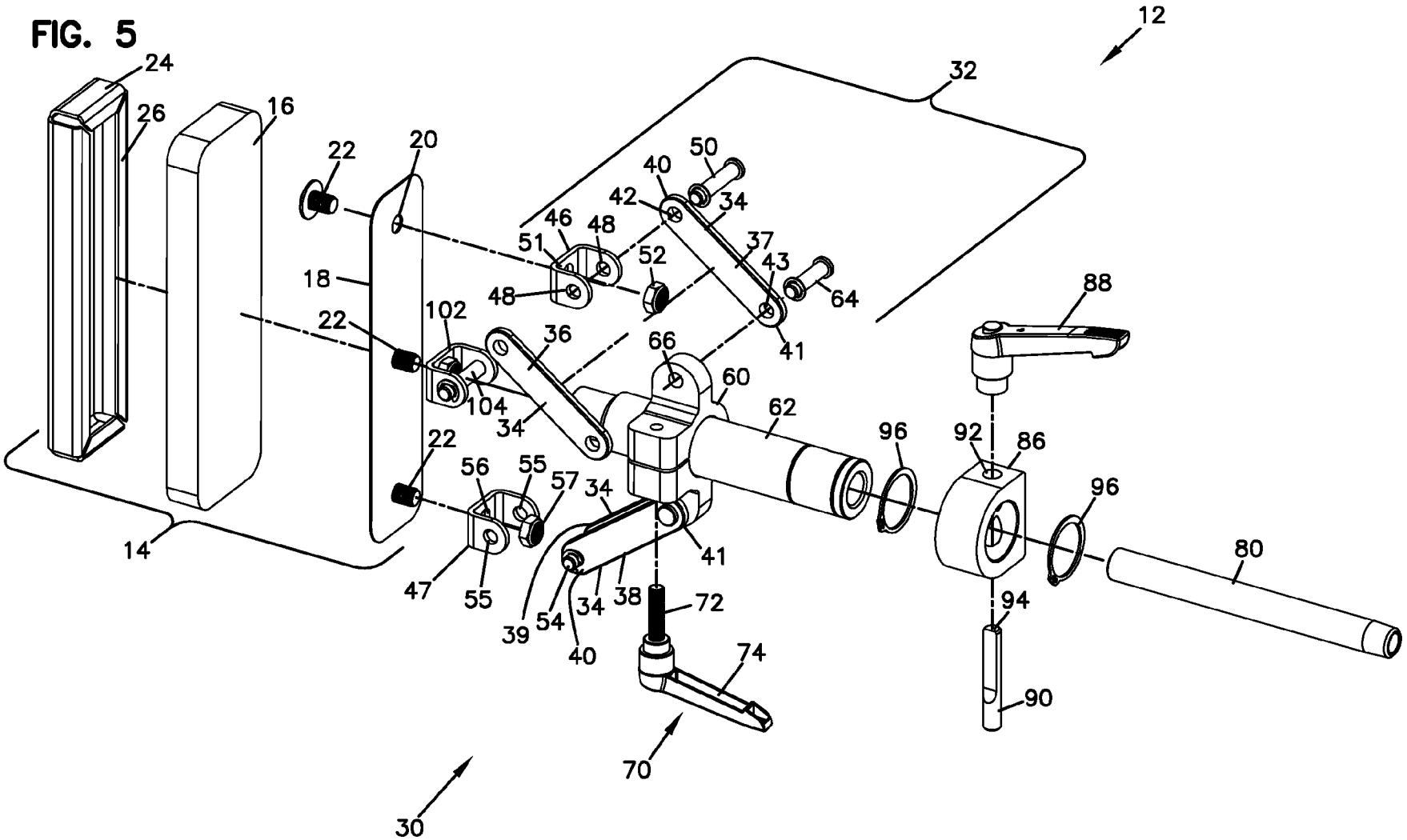
FIG. 5 is a perspective, exploded view of the stock assembly of FIG. 2.
Figure 6:
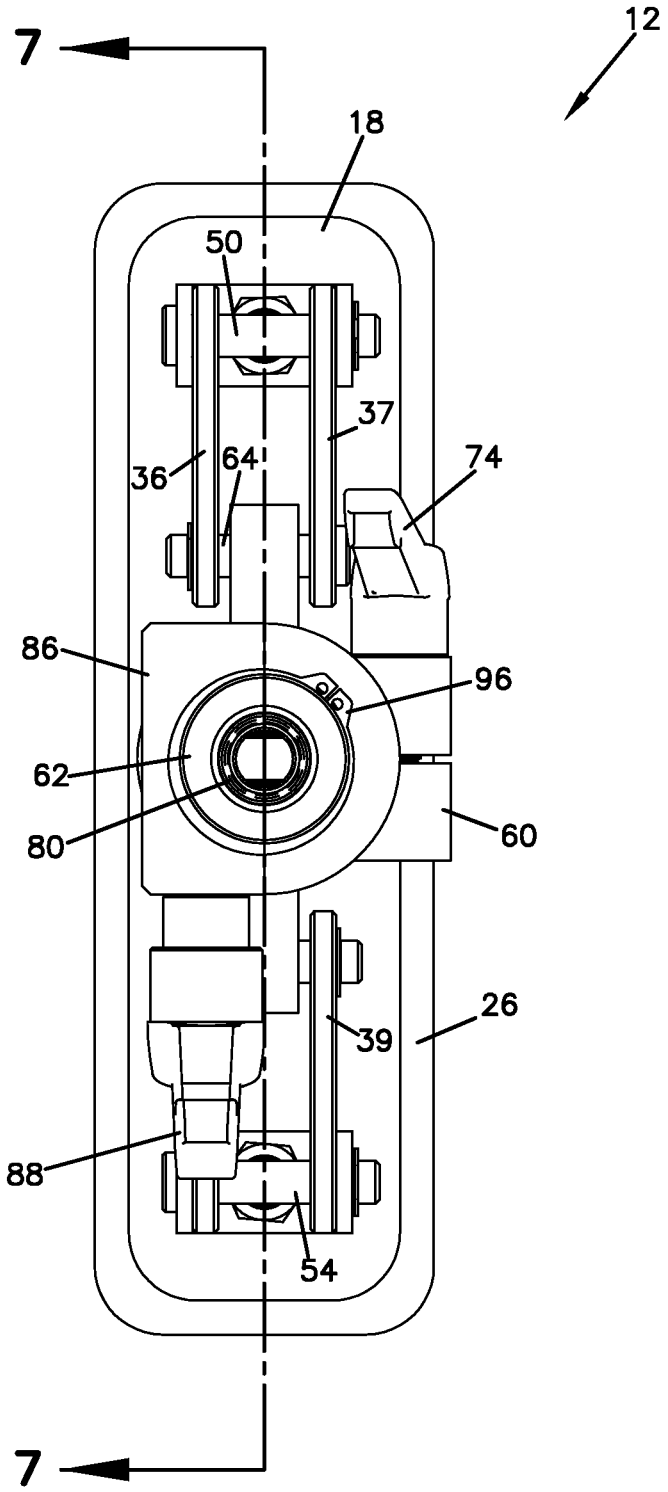
FIG. 6 is a front end view of the stock assembly of FIG. 2.

Many different types of pad arrangements 14 can be used. In the example shown in FIGS. 1 and 5, the pad arrangement 14 includes at least a body rest pad 16 (FIG. 5). The body rest pad 16 is generally made from a compressible material. In one example, the compressible material is foam. Of course, many other types of compressible material are usable.

In the example shown in FIG. 5, the pad arrangement 14 can also include a body rest plate 18 (spring plate 18). The body rest plate 18, in the example illustrated, is shown against the body rest pad 16. The body rest plate 18 can be used to attach the pad arrangement 14 to a remaining portion of the stock assembly 12.

The body rest plate 18 can be made from a variety of materials, generally which will allow for flexibility. By flexibility, it is meant that the material has inherent elasticity such that it can be changed in shape without undergoing permanent deformation. One usable material for the body rest plate 18 includes spring steel. Other materials can be used.

The body rest plate 18 can be used to secure the pad arrangement 14 to a remaining portion of the stock assembly 12. Many different ways for doing this are possible. In the embodiment shown in FIG. 5, the body rest plate 18 includes at least one aperture 20. The aperture 20 can be used to receive a fastener 22. More details on this example embodiment are described further below. In the example shown, there are three apertures 20, evenly spaced along a longitudinal extension of the body rest plate 18.

In some systems, the pad arrangement 14 may include a rest pad cover 24. In the example shown, the rest pad cover 24 is sized to receive, and/or wrap around, and/or snuggly hold the body rest pad 16 and body rest plate 18.

Figure 2:
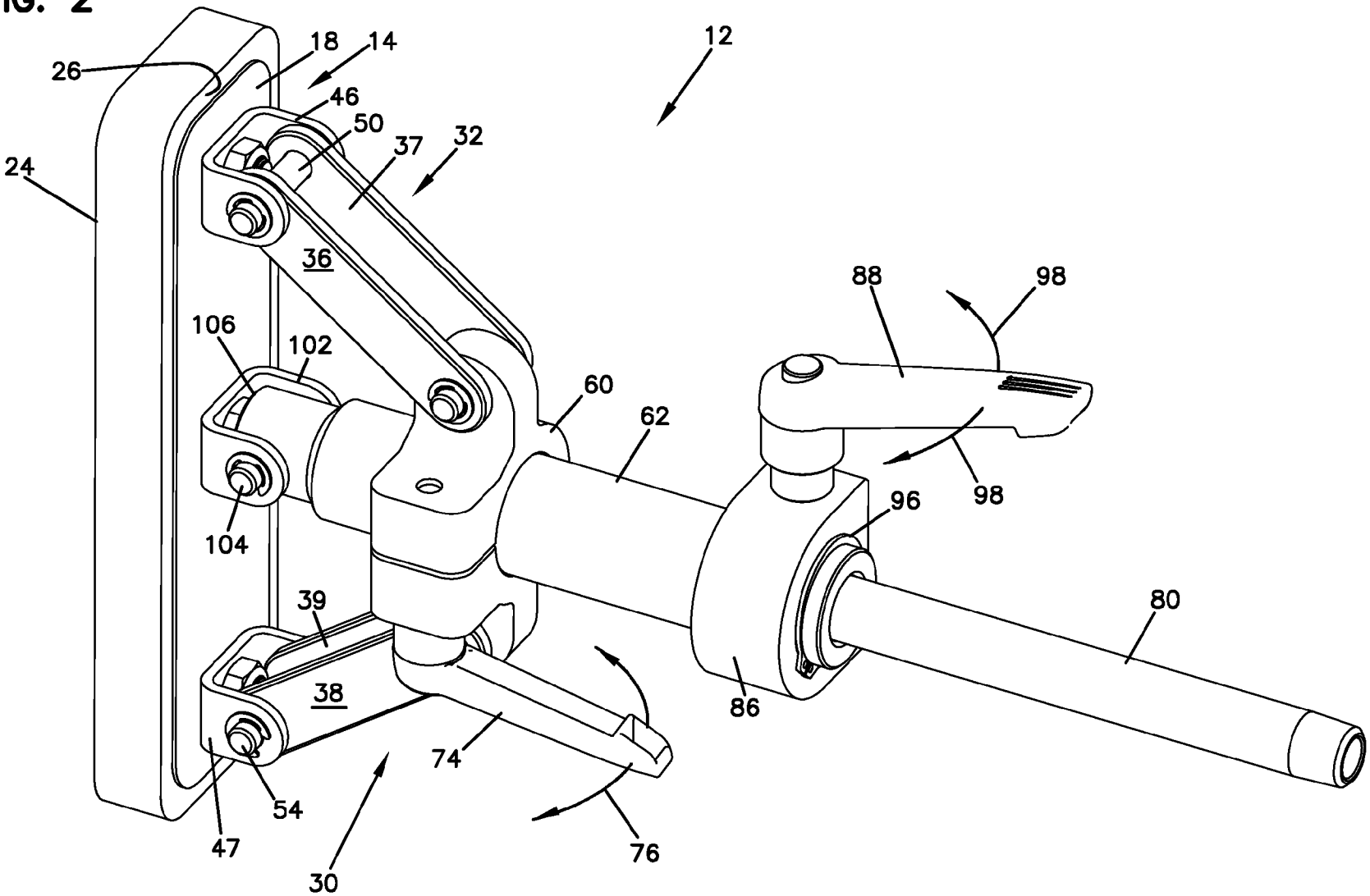
FIG. 2 is a perspective view of a stock assembly used with the fluid spray gun of FIG. 1.

For example, in some implementations, the rest pad cover 24 will hold the body rest plate 18 to the body rest pad 16. In FIG. 2, it can be seen how, in this example, the rest pad cover 24 wraps around the body rest pad 16 and includes a rim 26 that covers a periphery of the body rest plate 18.

The rest pad cover 24 can be made from many materials. In such embodiments, the rest pad cover 24 will be the material exposed and against the body of the gun operator. In such cases, it is desirable to have the rest pad cover 24 made from a comfortable material, yet one that will have durability. In one example, a usable material for the rest pad cover 24 is woven nylon. Many other types of materials can be used.

While the pad arrangement 14 can be many different shapes, in the example illustrated, it is generally rectangular in cross-section having opposite ends 118, 120 (FIG. 1), with a longitudinal extension therebetween. Of course, the pad arrangement can be other shapes.

The stock assembly 12 can also include a pad shape adjustment system 30. The pad shape adjustment system 30 is operably associated with the pad arrangement 14. Many different ways of operable association are contemplated and possible. In general, the pad shape adjustment system 30 is operable to change the profile shape of the pad arrangement 14.

In some examples, the pad shape adjustment system 30 is operable to change the profile shape of the pad arrangement 14 between at least a concave profile shape (FIG. 3), and/or a convex profile shape (FIG. 4), and/or a straight profile shape (FIGS. 1 and 2).

The pad shape adjustment system 30 can have many different implementations. In one example, the pad shape adjustment system 30 includes a linkage arrangement 32. The linkage arrangement 32 can be secured to the pad arrangement 14.

Attention is directed to FIG. 5. In FIG. 5, one example embodiment of a usable link arrangement 32 is illustrated, in exploded perspective view. In this particular embodiment, the linkage arrangement 32 includes a plurality of link arms 34. A first pair of link arms is shown at 36 and 37, while a second pair of link arms is shown at 38 and 39.

Each of the link arms 34 has a pad arrangement end 40 and an opposite clamp end 41. Adjacent to each of the ends 40, 41, each of the link arms 34 defines a pin aperture 42, 43, respectively.

The first pair of link arms 36, 37 connects to the pad arrangement 14 by way of a pivot angle plate 46. The second pair of link arms 38, 39 similarly connects to the pad arrangement 14 by way of a pivot angle plate 47. In this embodiment, the pad arrangement end 40 of each of the link arms 36 and 37 are received within the pivot angle plate 46. The pivot angle plate 46 has apertures 48, which can be aligned with the pin apertures 42 of the link arms 36, 37.

A pivot pin 50 passes through each of the apertures 42 and 48 to secure the link arms 36, 37 to the pivot angle plate 46. The pivot angle plate 46 is secured to the body rest plate 18 with the fastener 22 passing through the aperture 20 of the plate 18 and through an aperture 51 in the pivot angle plate 46.

As can be seen in FIG. 5, the pivot angle plate 46 is generally U-shaped, such that the axis of the aperture 51 is orthogonal to the axis of the apertures 48. A lock nut 52 mates with the fastener 22, which secures the link arms 36, 37 and pivot angle plate 46 to the body rest plate 18.

The link arms 36, 37 can rotate relative to the pivot pin 50.

In a similar way, the link arms 38, 39 are secured to the body rest plate 18. Specifically, the link arms 38, 39 are secured to the pivot angle plate 47 with a pivot pin 54 passing through apertures 55 of the pivot angle plate 47. One of the fasteners 22 passes through the body rest plate 18 and through an aperture 56 of pivot angle plate 47, and is secured by a lock nut 57. This connection allows the link arms 38, 39 to be secured to the body rest plate 18 and pivot about the pivot pin 54.

In this embodiment, the pad shape adjustment system 30 can include an adjustable clamp 60. The adjustable clamp 60 may be arranged such that when the clamp 60 is tightened, the pad arrangement is fixed in its profile shape, and when the clamp 60 is loosened, the profile shape of the pad arrangement 14 is changeable.

A first extension member 62 can be part of the stock assembly 12. The first extension member 62 is illustrated as being tubular, or cylindrical in shape. The first extension member 62 is illustrated as being generally orthogonal to the pad arrangement 14.

The adjustable clamp 60 can be releasably secured on the first extension member 62. When the adjustable clamp 60 is tightened relative to the first extension member 62, the pad arrangement 14 is fixed in profile shape. When the adjustable clamp 60 is loosened relative to the first extension member 62, the profile shape of the pad arrangement 14 is changeable.

The adjustable clamp 60 is secured to the linkage arrangement 32.

In one example, the linkage arrangement 32 is secured to the adjustable clamp 60 by way of pivot pins 64, 65 (FIG. 1) extending through apertures 43 (FIG. 5) in the clamp end 41 of each of the link arms 34. The pivot pins 64, 65 also extend through a respective flange aperture 66, 67 (FIG. 7) that is defined by the adjustable clamp 60.

The adjustable clamp 60, when loosened relative to the first extension member 62, can be moved along the length of the first extension member 62 to be either closer in position to the pad arrangement 14 or farther in distance from the pad arrangement 14.

When the clamp 60 is moved along the extension member 62, the linkage arrangement 32 will transmit forces to the pad arrangement 14 to change the profile shape of the pad arrangement 14.

Figure 3:
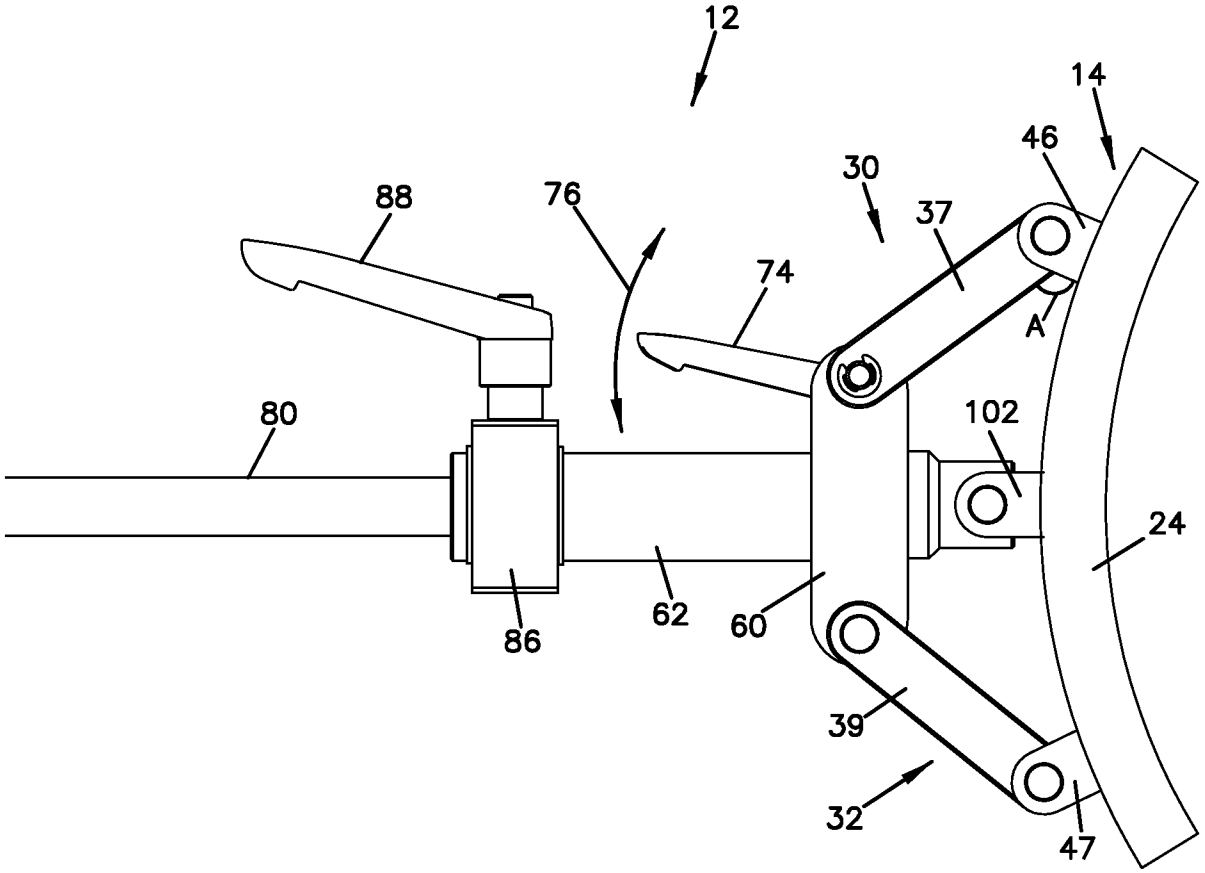
FIG. 3 is a side view of the stock assembly of FIG. 2, with the body rest pad arrangement in a concave position.

For example, in FIG. 2, the pad arrangement 14 is shown in a relatively straight position. In FIG. 3, the profile shape of the pad arrangement 14 is shown to be concave in shape. As can be seen in FIG. 3, the adjustable clamp 60 is closer in position to the pad arrangement 14 along the first extension member 62 than the position of the clamp arrangement 60 of FIGS. 2 and 7, with the pad arrangement 14 profile being generally straight.

Figure 4:
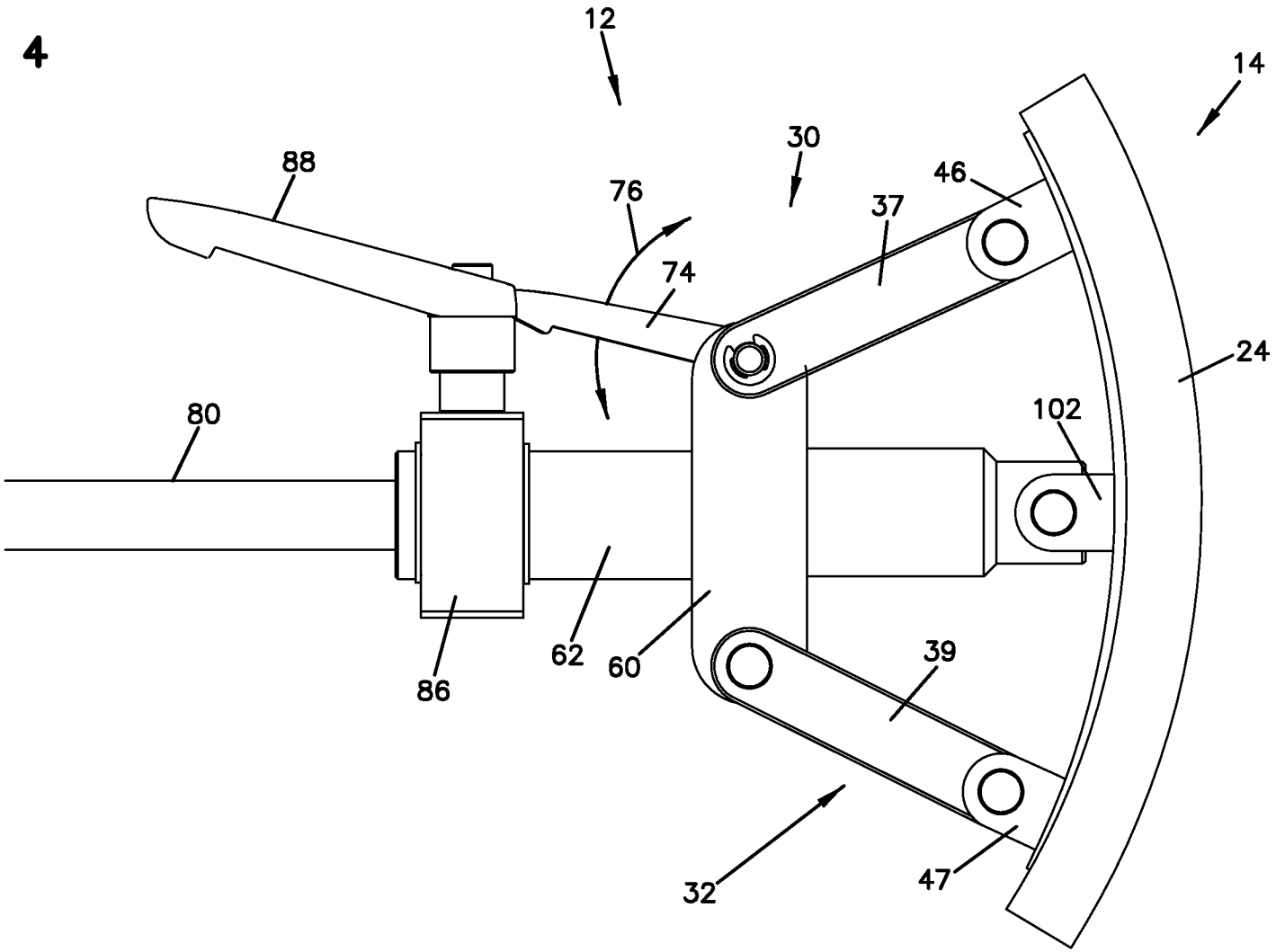
FIG. 4 is a side view of the stock assembly of FIG. 3, and with the body rest pad arrangement in a convex position.

In FIG. 4, the profile of the pad arrangement 14 is shown convex in shape. Comparing FIG. 4 to FIG. 3, it can be seen how the adjustable clamp 60 is farther in distance away from the pad arrangement 14, than the distance shown in FIG. 3. Also, comparing FIG. 4 to FIG. 7, it can be seen how the adjustable clamp 60 is farther in distance from the pad arrangement 14 in FIG. 4 than in FIG. 7.

Figure 7:
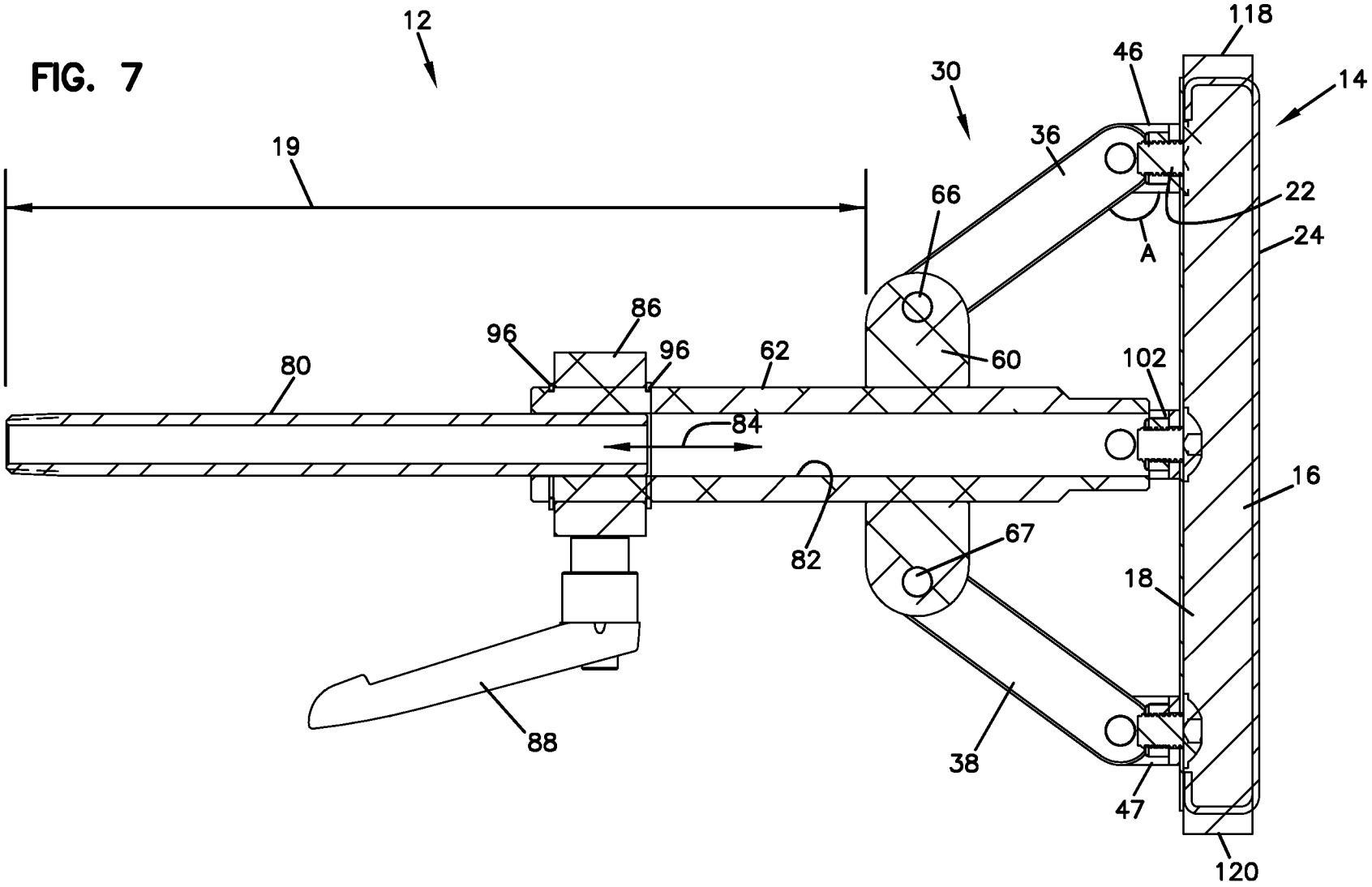
FIG. 7 is a cross-sectional view of the stock assembly of FIG. 2, the cross-section being taken along the line 7-7 of FIG. 6.

In FIG. 3, in the concave profile shape, it can be seen how the link arms 34 are angled at angle A relative to the pivot angle plates 46, 47. In FIG. 4, when the pad arrangement 14 has a convex shape, the link arms 34 align with and are straight relative to the pivot angle plates 46, 47. In FIG. 7, when the pad arrangement 14 is shown in a straight profile shape, again the link arms 34 are angled at angle A relative to the pivot angle plates 46, 47. The angle A of FIG. 7 is greater than the angle A of FIG. 3.

The stock assembly 12 includes a shape change handle 70. The shape change handle 70 is operably associated with the adjustable clamp 60 to be able to tighten or loosen the clamp 60. As can be seen in FIG. 5, the shape change handle 70 includes a threaded member 72. The threaded member 72 threads within the adjustable clamp 60 so that when the handle 70 is rotated, it can either tighten or loosen the clamp 60 relative to the first extension member 62.

In the embodiment shown, the shape change handle 70 has a hand grip part 74 that is generally about orthogonal to the threaded member 72. In FIGS. 2-4, arrow 76 illustrates how the hand grip part 74 can be adjusted to either tighten or loosen the clamp 60 relative to the first extension member 62.

The stock assembly 12, as mentioned previously, can also be adjustable lengthwise along arrow 19 to adjust the pad arrangement 14 either closer or further away from a remaining portion of the fluid spray gun 10. Many different ways of accomplishing this function are possible.

In the example illustrated, the stock assembly 12 includes a second extension member 80. The second extension member 80 can be made to be slidably adjustable relative to the first extension member 62 such that a total length of the first extension member 62 and second extension member 80 is adjustable from the pad arrangement 14. Another way of putting this is that the pad arrangement 14 can be moved either closer or further away from a remaining portion of the fluid spray gun 10.

In the example shown in FIG. 7, the second extension member 80 is tubular in shape, in the form of a cylinder. In this embodiment, the second extension member 80 is shown to fit within and be received within an open hollow tube 82 of the first extension member 62. Arrow 84 illustrates the direction of motion of the second extension member 80 relative to the first extension member 62. To make the total length of the two extension tubes 62, 80, shorter, the second extension member 80 is moved within the open hollow tube 82 in a direction toward the pad arrangement 14 (to the right in FIG. 7). To make the total length of the two extension members 62, 80 longer, the second extension member 80 is moved within the open hollow tube 82 in a direction away from the pad arrangement 14 (to the left in FIG. 7).

The stock assembly 12 can include a length adjustment clamp 86. The length adjustment clamp 86 can be used to be releasably secured to the first and second extension members 62, 80 such that when the length adjustment clamp 86 is tightened, the first and second extension members 62, 80 are fixed to each other. When the adjustment clamp 86 is loosened, the second extension member 80 can be slid relative to the first extension member 62 to adjust the total length of the first extension member 62 and second extension member 80 from the pad arrangement 14.

In the example embodiment shown in FIG. 5, there is a clamp handle 88 used with the length adjusting clamp 86. The length adjusting clamp 86 receives a cam shoulder stud 90 through a bore 92. The clamp handle 88 connects with end 94 of the stud 90. When the clamp handle 88 is rotated in one direction relative to the clamp 86, the stud 90 is moved into a position that frees the second extension member 80 relative to the first extension member 62 to allow for adjustment of the length. When the clamp handle 88 is moved or rotated in the opposite position, the stud 90 is rotated such that it presses against the second extension member 80 and fixes it or locks it in place relative to the first extension member 62.

A pair of retaining rings 96 can also be used with the length adjustment clamp 86 to help keep the extension members 62, 80 locked together with the length adjustment clamp 86 thereon. The retaining rings 96 can be omitted, as well. The clamp handle 88 is rotatable in the direction of arrow 98 as shown in FIG. 2. In FIGS. 3 and 4, the direction of rotation of clamp handle 88 would be into and out of the page.

As mentioned previously, the pad arrangement 14 can be rotationally adjustable, as shown at arrow 15 in FIG. 1. In this embodiment, the pad arrangement 14 can be rotated relative to the second extension member 80 by loosening the length adjustment clamp 86, which will allow the first extension member 62 connected to the pad arrangement 14 to pivot or rotate relative to second extension member 80 and about the axis 13.

The first extension member 62 is attached or secured to the pad arrangement 14. In the embodiment shown in FIG. 2, a pivot angle plate 102 receives a pivot pin 104, which passes through appropriate holes in the first extension member 62 adjacent an end 106 of the first extension member 62. One of the fasteners 22 (FIG. 5) extends through the body rest plate 18 and the pivot angle plate 102 to secure the pivot angle plate 102 to the body rest plate 18. In this way, the first extension member 62 is secured to the body rest plate 18 of the pad arrangement 14.

The stock assembly 12 can be used with many different types of equipment. In this example, and as shown in FIG. 1, the stock assembly 12 is used with the fluid spray gun 10. Many different embodiments of fluid spray guns 10 are possible. In this embodiment, the spray gun 10 includes a fluid supply tube 108. The fluid supply tube 108 is typically connected up with a hose that is in fluid communication with some type of holding tank or water or whatever fluid is being used.

In the embodiment shown in FIG. 1, the fluid spray gun 10 includes a block 110. The fluid supply tube 108 is in fluid communication with the block 110. The block 110 can include appropriate valves and cartridges to help control the flow of fluid from the tube 108 to the rest of the gun 10.

A barrel 112 is in fluid communication with the block 110. A trigger 114 operably controls fluid release from the block 110 and into the barrel 112. The barrel has an end spray nozzle at 115. In the embodiment of FIG. 1, the spray gun 10 further includes a grip 116 secured to the barrel 112 and spaced from the block 110.

The spray gun 10 including the fluid supply tube 108, block 110, barrel 112, trigger 114, nozzle 115, and grip 116 are known in the art. For example, see patent publication US 2012/0223163, incorporated herein by reference.

The adjustable stock assembly 12 is connected to a remaining portion of the gun 10. In the example shown in FIG. 1, the connection between the stock assembly 12 and the remaining portion of the gun 10 is at the block 110. The pad arrangement 14 is adjustable relative to the position of the block 110 and/or trigger 114.

For example, as explained above, the pad arrangement 14 can be moved closer or further away from the remaining portion of the gun 10. In implementations that have a trigger 114 or block 110, the pad arrangement can be moved closer or further away from the trigger 114 or block 110 by using the length adjustment clamp 86 to then move the second extension member 80 relative to the first extension member 62 to either lengthen or shorten the total length of the first extension member 62 plus the second extension member 80.

In another example, the pad arrangement 14 can be changed from the straight shape shown in FIG. 1 to various degrees of concavity (FIG. 3) to convexity (FIG. 4). The pad arrangement 14 may be rotated relative to the block 110 as shown at arrow 15 in FIG. 1.

Figure 8:
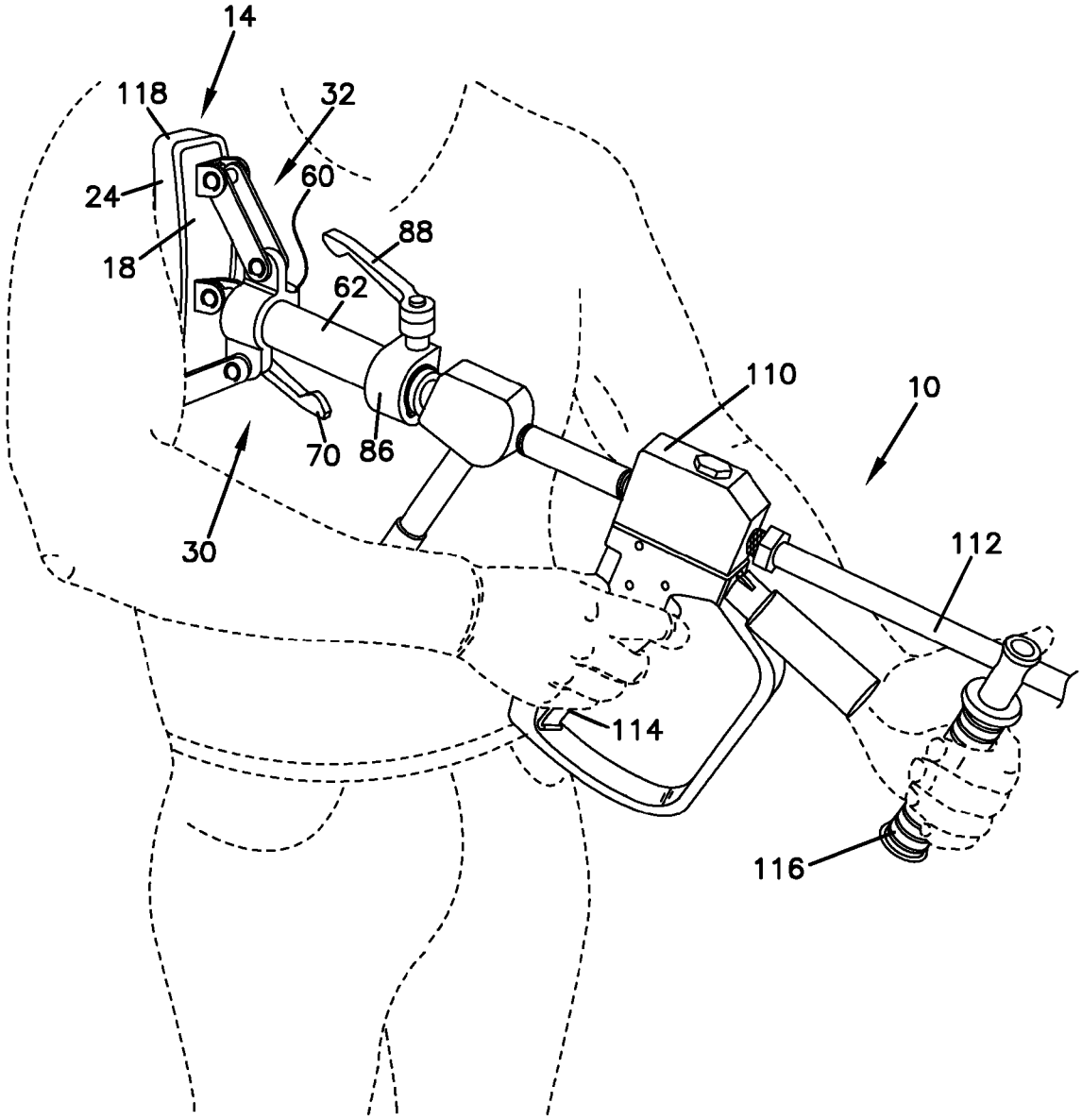
FIG. 8 is a schematic, perspective view of an operator (person) using the fluid spray gun, in which the pad arrangement has a concave profile shape.

FIG. 8 illustrates an operator using the gun 10, in which the pad arrangement 14 has a profile shape that is concave. The rotational position of the pad arrangement 14 is such that the longitudinal extension between opposite ends 118, 120 are vertically above and below, respectively, the axis 13 (FIG. 1), when the trigger 114 is pointing downward.

Figure 9:
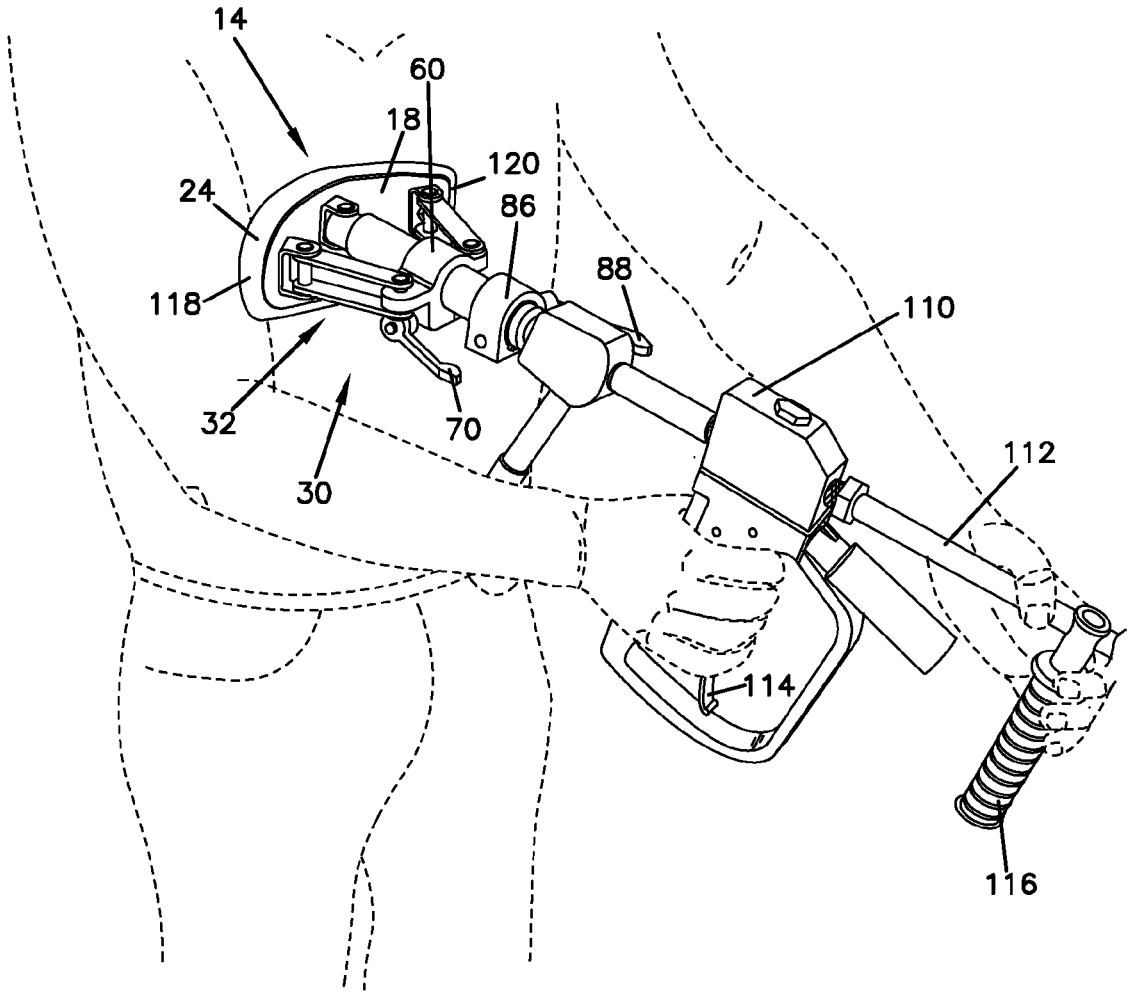
FIG. 9 is a schematic, perspective view of an operator (person) using the fluid spray gun of FIG. 1, in which the pad arrangement has a convex profile shape.

In FIG. 9, the operator is shown using the gun 10 with the stock assembly 12 adjusted so that the pad arrangement 14 is in a convex profile shape. In addition, in FIG. 9, the rotational position of the pad arrangement 14 is such that the longitudinal extension between the ends 118, 120 are to the left and right, respectively, of the axis 13 (FIG. 1), when the trigger 114 is pointing downwardly. In other words, the pad arrangement 14 has been rotated about 90 degrees in FIG. 9 from its position in FIG. 8 about the axis 13.

Attention is now directed to the embodiment of the stock assembly of FIGS. 10-13 shown in general at 12'. The stock assembly 12' has many of the same parts as the stock assembly 12 and where appropriate, the same reference numerals are used for the same parts. Thus, description of these parts is not repeated here, but is incorporated herein by reference with respect to this embodiment.

The stock assembly 12' is similar to the stock assembly 12 of FIGS. 1-9 in that the profile shape of the body rest pad 16 can be changed. In addition, either independent of or in combination, the angular (rotational) orientation of the pad arrangement 14 can be changed relative to a remaining portion of the spray gun 10. In addition, in combination with or independent of the above, the length of the stock assembly 12 relative to the rest of the spray gun 10 can be changed. Further, in this embodiment of FIGS. 10-13, either in combination with any of the previous adjustment, or independent of the previous adjustments, the pad arrangement 14 is tiltable relative to a remaining portion of the stock assembly 12 or the spray gun 10.

Figure 10:
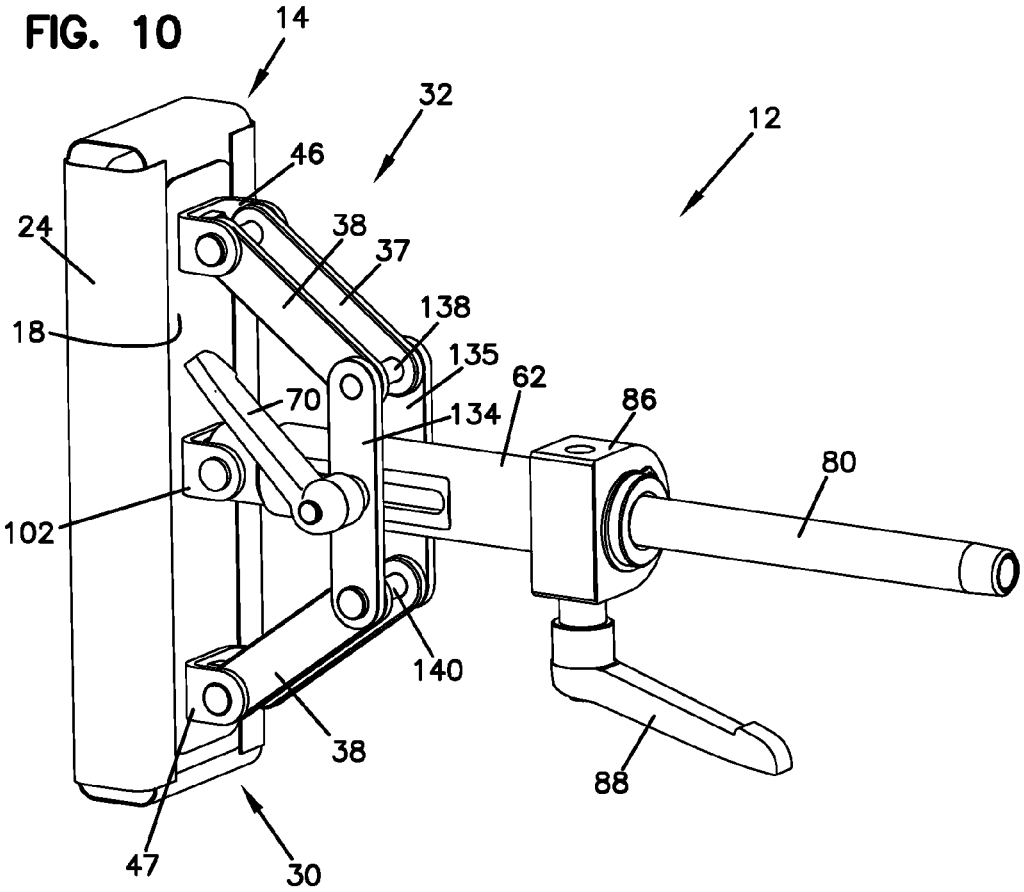
FIG. 10 is a perspective view of another embodiment of a stock assembly having an adjustable tilt angle, constructed in accordance with principles of this disclosure.
Figure 11:
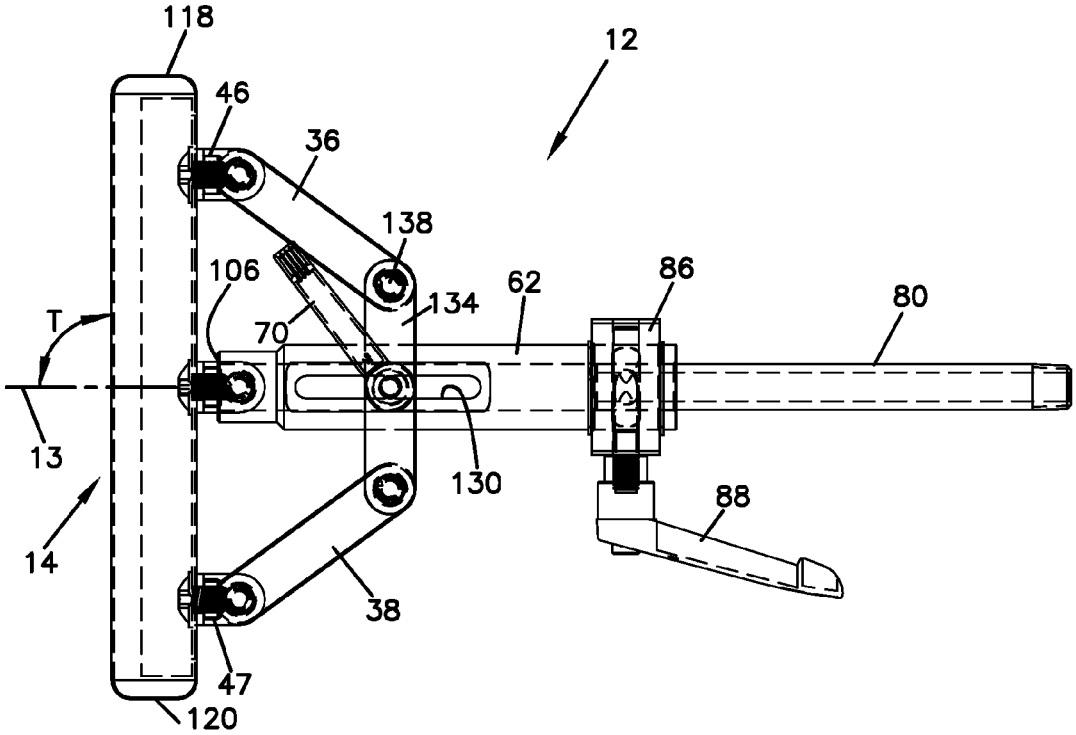
FIG. 11 is a side view of the stock assembly of FIG. 10.
Figure 12:
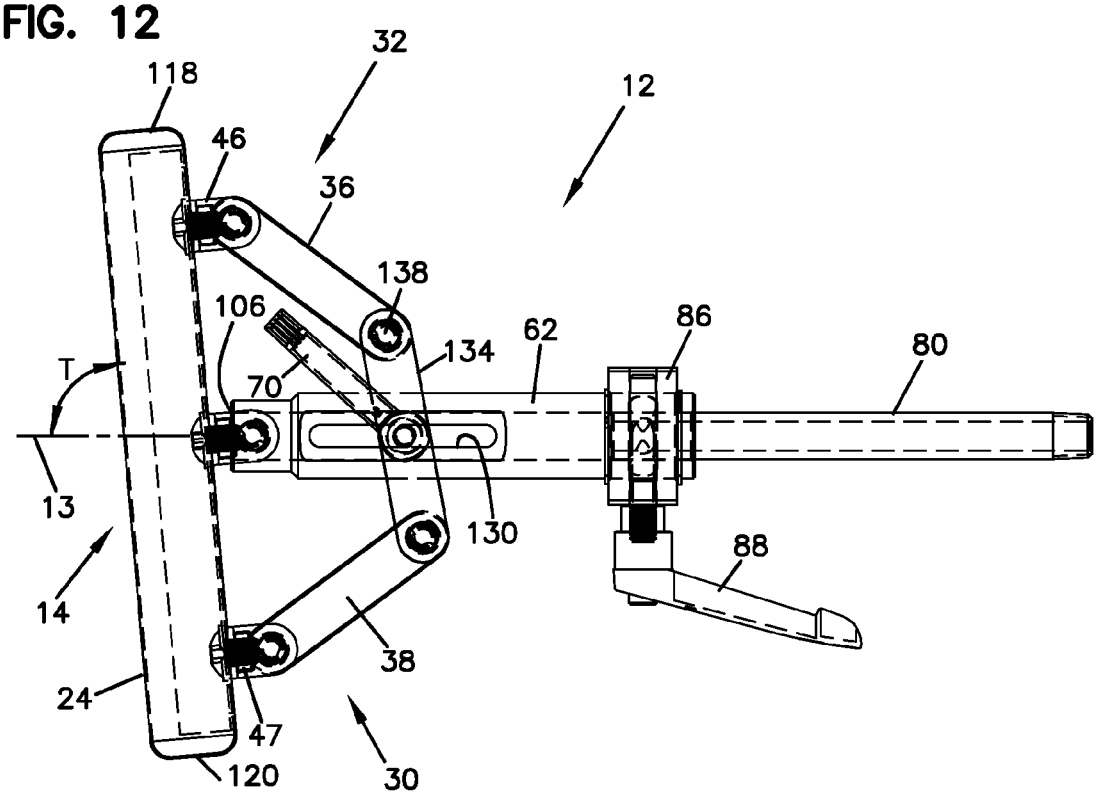
FIG. 12 is another side view of the stock assembly of FIG. 10, with the body rest pad arrangement tilted so the bottom of the pad arrangement is closer to a remaining portion of the fluid spray gun than the top of the pad arrangement.
Figure 13:
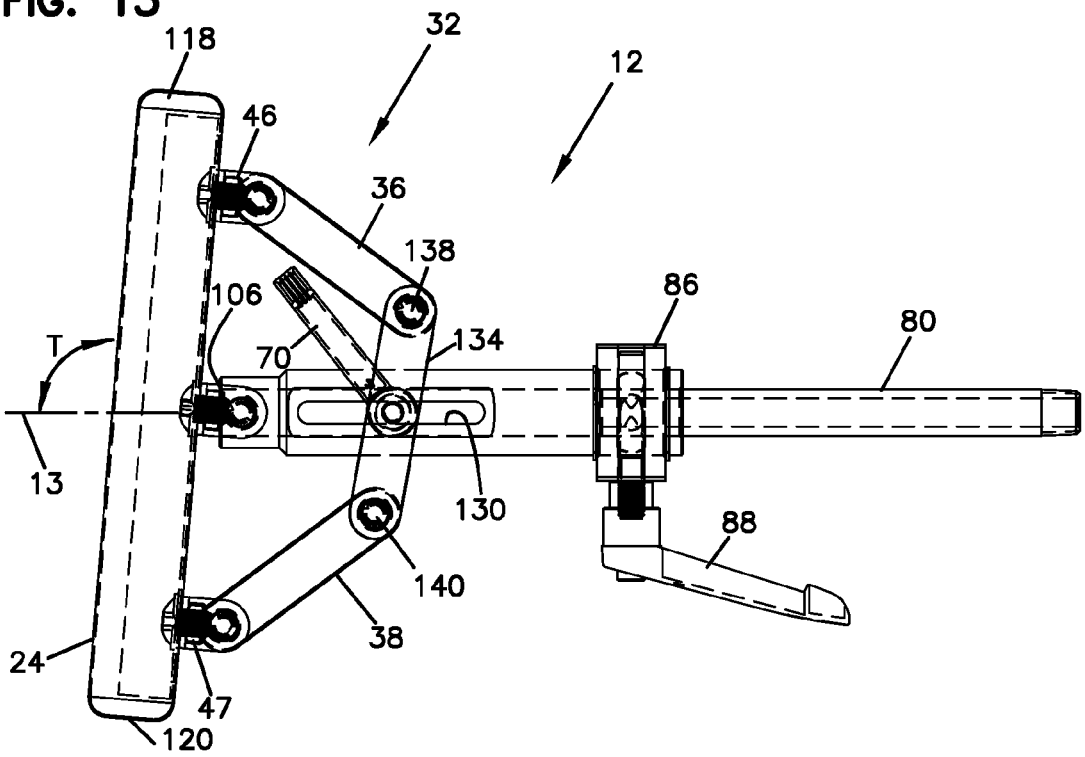
FIG. 13 is another side view of the stock assembly of FIG. 10, with the body rest pad arrangement tilted so the top of the pad arrangement is closer to a remaining portion of the fluid spray gun than the bottom of the pad arrangement.

In the example embodiment shown in FIGS. 10-13, the pad arrangement 14 is shown angled or tilted relative to the axis 13 of the stock assembly 12, and of the overall spray gun 10, when the stock assembly 12' is attached to the rest of the gun 10. In FIGS. 10 and 11, the pad arrangement 14 is shown generally orthogonal or perpendicular to the axis 13. In FIG. 12, the pad arrangement 14 is shown tilted relative to the axis 13, such that the end 120, corresponding to the bottom of the pad arrangement 14, is closer to a remaining portion of the fluid spray gun 10 and the remaining portion of the stock assembly 12', than the end 118 or top of the pad arrangement 14. In FIG. 13, the pad arrangement 14 is tilted relative to the axis 13, such that the top end 118 is closer to a remaining portion of the stock assembly 12' and spray gun 10, than the bottom end 120. As can be seen in FIGS. 11-13, the angle T between axis 13 and the pad arrangement 14 is greatest in FIG. 13, when the top end 118 is angled closer to the remaining portion of the stock assembly 12' than the bottom end 120. The angle T is the smallest as shown in FIG. 12. The angle T is at about 90° in FIG. 11 and is between the angles shown in FIGS. 12 and 13.

In the embodiment of FIGS. 10-13, the linkage arrangement 32 includes, the first link pair at link arms 36 and 37; the second link pair shown at link arms 38 and 39; and a third link pair having link arms 134 and 135. The link arms 134, 135 are secured to each of the first link pair 36, 37 and second link pair 38, 39.

In the embodiment shown, the link arm 134 is secured to an end of the link arm 36. An opposite end of the link arm 134 is secured to an end of the link arm 38. The link arm 135 is secured to an end of the link arm 37. An opposite end of the link arm 135 is secured to an end of the link arm 39.

A pivot pin 138 secures the link arm 36 to the link arm 134, and the link arm 37 to the link arm 135. The pivot pin 138 also secures link arm 36 to link arm 37 as well as link arm 134 to link arm 135.

Similarly, pivot pin 140 secures link arm 134 to link arm 38 and link arm 135 to link arm 39. The pivot pin 140 also secures the link arm 134 to the link arm 135, and the link arm 38 to the link arm 39.

In FIG. 10, it can be seen how the first extension member 62 is located in the volume between the spaced apart link arms 134, 135. The link arms 134, 135 can be moved, such as be angling or tilting from the vertical position of FIGS. 10 and 11 to positions off-vertical (FIGS. 12 and 13) to change the tilt angle T of the pad arrangement 14. As mentioned previously, this adjustment of the tilt angle T can be independent of the other adjustment features.

When the tilt angle adjustment is used in combination with the pad arrangement 14 profile adjustment, the first extension member 62 can include or defines a slot arrangement 130 for cooperation with the shape change handle 70. The slot arrangement 130 is generally elongated and extends from a region adjacent to the end 106 of the first extension member 62 along the side to a region short of the where the length adjustment clamp 86 is located. The slot arrangement 130 cooperates with the linkage arrangement 32 and shape change handle 70. In embodiments that do not permit adjustment of the profile shape of the pad arrangement, the shape change handle 70 and/or slot arrangement 130 is not part of the embodiment.

In this embodiment, the shape change handle 70 is secure to the linkage arrangement 32 at link arm 134. The shape change handle 70 is releasably secured to the first extension member 62 along the slot arrangement 130.

For example, the shape change handle 70 can extend through an opening in the link arm 134 and be received within the slot arrangement 130. The shape change handle 70 can be selectively tightened or loosened relative to the first extension member 62 within the slot arrangement 130. When the shape change handle 70 is tightened, then the pad arrangement 14 is fixed in both the tilt position and profile shape. When the shape change handle 70 is loosened, then the linkage arrangement 32 can be moved, and this permits changing of one or both of the profile shape of the pad arrangement 14 and the tilt angle T of the pad arrangement 14.

For example, when the shape change handle 70 is loosened, the link pair 134, 135 can be moved along the slot arrangement 130. When it is moved, the link pair 134, 135 can be angled from a straight vertical orientation to an orientation that is off-vertical, which will change the tilt angle T of the pad arrangement 14. The profile shape of the pad arrangement 14 can also be changed by adjusting the angles between the link arm pair 36, 37 and pivot angle plate 46; and the link arm pair 38, 39 and pivot angle plate 47. The shape change handle 170 can again be tightened relative to the slot arrangement 130 to fix the shape and tilt angle T of the pad arrangement 14 in place. Of course, as previously described, the rotational position of the pad arrangement 14 can be adjusted by loosening the length adjustment clamp 86 to allow rotation of the first extension member 62 relative to the second extension member 80. Further, if desired, the length of the pad arrangement 14 relative to the rest of the spray gun 10 can be adjusted by adjusting the length of the second extension member 80 relative to the first extension member 62, as previously discussed.

A method of changing the profile shape of the pad arrangement 14 of the stock assembly 12, 12' can be implemented. The method includes loosening a connection between the linkage arrangement 32 and a remaining portion of the stock assembly 12, 12'. The linkage arrangement 32 is secured to the pad arrangement 14. Next, the linkage arrangement 32 is moved to cause the profile shape of the pad arrangement 14 to change from an initial shape to a new shape. Next the connection between the linkage arrangement 32 and the remaining portion of the stock assembly 12, 12' is tightened to fix the new shape of the pad arrangement 14.

In one example, the step of loosening a connection includes loosening adjustment clamp 60 secured to the linkage arrangement 32. The step of moving the linkage arrangement 32 includes moving the clamp 60 to move the linkage arrangement 32 secured to the pad arrangement 14.

In one example, the clamp 60 is moved away from the pad arrangement 14 to move the profile shape of the pad arrangement 14 from a straight position (FIG. 2) to a convex position (FIG. 4). In another example, the clamp 60 is moved toward the pad arrangement 14 to move the profile from the convex position of FIG. 4 to either a straight position of FIG. 2 or a concave position of FIG. 3. In another example, the clamp 60 is moved toward the pad arrangement 14 to cause the profile shape to change from a straight profile of FIG. 2 to a concave profile of FIG. 3.

In one example method, the stock assembly 12' includes first extension member 62 having slot arrangement 130. The step of loosening a connection includes loosening the shape change handle 70 secured to the linkage arrangement 32 and releasably secured within the slot arrangement 130. This will permit the linkage arrangement 32 to be moved relative to the first extension member 62 and allow for a change in the profile shape of the pad arrangement 14. In addition, the method can further include changing the tilt able of the pad arrangement 14 relative to an axis of the spray gun 10.

A method of changing the rotational position of the pad arrangement 14 includes loosening the adjustable clamp 60 secured to the first extension member 62, and then rotating or pivoting the pad arrangement 60 relative to axis 13 that longitudinally extends along the first extension member 62. The adjustable clamp 60 is again tightened to fix the rotational position of the pad arrangement 14 relative to the first extension member 62.

A method of changing the length of the stock assembly 12 relative to a remaining portion of the spray gun 10 includes loosening the length adjustment clamp 86, and then moving the second extension member 80 relative to the first extension member 62, and then re-tightening the length adjustment clamp 86. The first extension member 62 is secured to the pad arrangement 14, while the second extension member 80 is secured to the block 110 of the spray gun 10.

A method of changing the tilt angle of the pad arrangement 14 includes moving a linkage arrangement 32 connected to the pad arrangement 14 to cause one end 118, 120 of the pad arrangement 14 to tilt away from an original position to a new position angled from the initial position.

In some embodiments, there is a step of loosening a connection between the linkage arrangement 32 and a remaining portion of the stock assembly 12'. After moving the linkage arrangement 32 to change the tilt angle, the connection between the linkage arrangement 32 and the remaining portion of the stock assembly 12' is tightened to fix the tilt angle T of the pad arrangement 14.

The above description presents example principles. Many different embodiments can be made using these principles.

What is claimed is:

1. An adjustable stock assembly for a fluid spray gun, the stock assembly comprising: (a) a flexible body rest pad arrangement having a profile shape; and (b) a pad shape adjustment system operably associated with the pad arrangement; (i) the pad shape adjustment system being operable to change the profile shape of the pad arrangement between at least a concave profile shape, a convex profile shape, and a straight profile shape.

2. The adjustable stock assembly of claim 1 wherein:

(a) the pad shape adjustment system includes a linkage arrangement secured to the pad arrangement.

3. The adjustable stock assembly of claim 2 further comprising:

(a) a first extension member, at least a portion of the pad shape adjustment system being adjustably fixed to the first extension member;

(i) the first extension member defining a slot arrangement; and (b) a shape change handle secured to the linkage arrangement and releasably secured to the first extension member along the slot arrangement.

4. The adjustable stock assembly of claim 3 wherein:

(a) the linkage arrangement includes a first link pair secured to the pad arrangement, a second link pair secured to the pad arrangement, and a third link pair secured to each of the first link pair and second link pair.

5. The adjustable stock assembly of claim 1 wherein:

(a) the pad shape adjustment system includes an adjustable clamp such that when the clamp is tightened, the pad arrangement is fixed in profile shape, and when the clamp is loosened, the profile shape of the pad arrangement is changeable.

6. The adjustable stock assembly of claim 5 further comprising:

(a) a shape change handle operably secured to the clamp, the shape change handle being operable to tighten or loosen the clamp.

7. The adjustable stock assembly of claim 1 wherein:

(a) the pad arrangement includes at least a body rest pad of compressible material and a body rest plate against the body rest pad.

8. The adjustable stock assembly of claim 7 wherein:

(a) the pad shape adjustment system includes a linkage arrangement secured to the body rest plate of the pad arrangement.

9. The adjustable stock assembly of claim 8 wherein:

(a) the pad shape adjustment system includes an adjustable clamp secured to the linkage arrangement.

10. The adjustable stock assembly of claim 9 wherein:

(a) the adjustable clamp is operably associated with the linkage arrangement such that when the clamp is tightened, the pad arrangement is fixed in profile shape, and when the clamp is loosened, the clamp can move the linkage arrangement and change the profile shape of the pad arrangement.

11. The adjustable stock assembly of claim 1 further comprising:

(a) a first extension member, at least a portion of the pad shape adjustment system being adjustably fixed to the first extension member; and (b) a second extension member slidably adjustable relative to the first extension member such that a total length of the first extension member and second extension member is adjustable from the pad arrangement.

12. The adjustable stock assembly of claim 11 further comprising:

(a) a length adjustment clamp releasably secured to the first and second extension members such that when the length adjustment clamp is tightened, the first and second extension members are fixed to each other, and when the adjustment clamp is loosened, the second extension member can be slid relative to the first extension member to adjust the total length of the first extension member and second extension member from the pad arrangement.

13. The adjustable stock assembly of claim 1 further comprising:

(a) a first extension member, at least a portion of the pad shape adjustment system being adjustably fixed to the first extension member; and (b) the pad arrangement being rotatably adjustable relative to the first extension member.

* * * * *